US008419483B2

(12) United States Patent
Aoki et al.

(10) Patent No.: US 8,419,483 B2
(45) Date of Patent: Apr. 16, 2013

(54) TERMINALS CONNECTING STRUCTURE

(75) Inventors: Eiji Aoki, Makinohara (JP); Yasuhiro Tanaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/144,969

(22) PCT Filed: Sep. 16, 2010

(86) PCT No.: PCT/JP2010/066622

§ 371 (c)(1),
(2), (4) Date: Jul. 18, 2011

(87) PCT Pub. No.: WO2011/034211

PCT Pub. Date: Mar. 24, 2011

(65) Prior Publication Data

US 2011/0275251 A1 Nov. 10, 2011

(30) Foreign Application Priority Data

Sep. 16, 2009 (JP) ..... 2009-214492

(51) Int. Cl.
*H01R 9/22* (2006.01)

(52) U.S. Cl.
USPC ..... 439/709

(58) Field of Classification Search ..... 439/709–721, 439/801, 808, 620.8, 883
See application file for complete search history.

(56) References Cited

U.S. PATENT DOCUMENTS

| | | | |
|---|---|---|---|
| 5,704,815 | A | 1/1998 | Shibata et al. |
| 2007/0138882 | A1 | 6/2007 | Tsukashima et al. |

FOREIGN PATENT DOCUMENTS

| | | | |
|---|---|---|---|
| FR | 2 667 989 | A1 | 4/1992 |
| JP | 08-322125 | A | 12/1996 |
| JP | 2000-067833 | A | 3/2000 |
| JP | 2004-227928 | A | 8/2004 |
| JP | 2005-229755 | A | 8/2005 |

OTHER PUBLICATIONS

International Search Report (PCT/ISA/210), dated Dec. 30, 2010, issued in Application No. PCT/JP2010/066622.
Written Opinion (PCT/ISA/237), dated Dec. 30, 2010, issued in Application No. PCT/JP2010/066622.

*Primary Examiner* — Briggitte R Hammond
(74) *Attorney, Agent, or Firm* — Sughrue Mion, PLLC

(57) ABSTRACT

To provide a terminals connecting structure which can prevent a terminal of two types of terminals which is mounted later from plunging into an inside of or pushing up a terminal which is mounted first with a simple structure in stacking the two types of terminals one on the other for connection in an electric equipment connecting terminal block.
A plunge prevention portion 22 which is bent inwards towards an inverter terminal block 10 is formed at a leading end portion of a capacitor bus-bar terminal 20, and a guide rib 17 is formed on a lateral side of the terminal block 10 which faces an inverter connector terminal 30 in a position lying in proximity to a nut 12A so as to project outwards along a direction in which the inverter connector terminal 30 enters.

3 Claims, 11 Drawing Sheets

TERMINALS CONNECTING STRUCTURE

TECHNICAL FIELD

The present invention relates to an electric equipment connecting connector which can electrically connect an auxiliary such as a motor of an electric vehicle (including a hybrid car), for example, and various types of equipment such as a DC/AC inverter and more particularly to a terminals connecting structure which is suitable for stacking together two types of terminals which extend from different directions in a terminal block for connecting together various types of electric equipment for electrical connection.

BACKGROUND ART

As conventional bus-bar fastening structures, there have been known bus-bar fastening structures which are disclosed in JP-A-2004-227928(PTL1), JP-A-2000-067833(PTL2), JP-A-2005-229755 (PTL3) and JP-A-8-322125 (PTL4), for example.

Namely, in PTL 1, as is shown in FIG. 11, PTL1 describes a structure in which one end 110A of a bus-bar 110 is connected to a negative pole pillar 100 by fitting the one end 110A on the negative pole pillar 100 and thereafter screwing a nut on to a thread portion 100A of the pole pillar 100, while the other end 110B of the bus-bar 110 is connected to a power supply breaker situated outside the figure. Note that in the figure, reference numeral 120 denotes a holder made of a synthetic resin, 121 a bus-bar sealing portion where the bus-bar 110 is sealed, 130 a lithium ion battery (a secondary battery), and 140 a service plug mounting portion.

CITATION LIST

Patent Literature

[PTL 1] JP-A-2004-227928
[PTL 2] JP-A-2000-067833
[PTL 3] JP-A-2005-229755
[PTL 4] JP-A-8-322125

SUMMARY OF INVENTION

Technical Problem

Apart from the aforesaid conventional fastening structures for bus-bars or the like, for example, a fastening structure is seen often in various fields in which two types of terminals which enter from different directions are fastened together with a nut and a bolt for electric connection. In the event that two types of terminals are fastened together with a nut and a bolt for electric connection, a connecting method is often adopted in which for example, a first terminal (hereinafter, referred to as a "leading terminal") is set on the nut, a second terminal (referred to as a "trailing terminal") is then stacked on the leading terminal, and thereafter, a bolt is inserted through respective holes in the leading and trailing terminals so as to fasten them together.

In the case of the connecting work of stacking the two types of terminals one on the other so as to be fastened together, in the event that a leading end of the trailing terminal is lower than a leading end face of the leading terminal with respect to a height position in a vertical direction, the trailing terminal moves into an inside (for example, a lower side) of the leading terminal, causing a problem that these bolts cannot be fastened together quickly with the bolt.

Namely, in the event that the work of stacking the two types of terminals one on the other so as to fasten them together (hereinafter, referred to as "terminals fastening work") is performed manually, for example, a procedure is necessary of stacking the trailing terminal on the leading terminal while the leading terminal is being fixed in a predetermined position by one hand. In addition, also when the terminals fastening work like this is performed automatically by a robot, it is necessary that similar stacking work to that manually performed by the operator is performed by the robot which has two hands, there being a fear that man hours have to be taken in performing the fastening work, whereby the working efficiency is reduced.

Further, in performing the terminals fastening work like this, when a leading end face of the trailing terminal is not parallel to the leading end face of the leading terminal, even in the event that the heights of the respective leading ends of both the terminals coincide with each other, the leading end of the trailing terminal strikes the leading end of the leading terminal, whereby there is called for a fear that a leading end side of the leading terminal is pushed up (hereinafter, this action being referred to also as "thrusting").

The invention has been made in view of the situations described above, and an object thereof is to provide a terminals connecting structure which can prevent one of two types of terminals which is mounted later pushing up the other terminal which is mounted beforehand with a simple construction in stacking the two types of terminals one on the other so as to connect them together in an electric equipment connecting terminal block.

Solution to Problem

With a view to attaining the object, a terminals connecting structure according to the invention is characterized by (1) and (2) below.

1. (1) A terminals connecting structure, comprising:

a terminal block including a group of block terminal fixing portions;

two types of terminals that are entered from different directions towards the group of block terminal fixing portions and that are stacked one on the other on at least a block terminal fixing portion of the group of block terminal fixing portions, the two types of terminals and the block terminal fixing portion being fastened and assembled together with a bolt;

wherein a plunging prevention portion that is bent inwards towards the terminal block is formed at a leading end portion of a terminal of the two types of terminals which enters first the block terminal fixing portion; and wherein a guide rib which projects outwards along a direction in which a terminal which enters later enters is formed in a position on a lateral side of the terminal block which lies in proximity to the block terminal fixing portion and faces the terminal which enters later;

wherein with the terminal which enters first to be stacked on the block terminal fixing portion seen from the top, the guide rib is positioned at a center of the terminal which enters first.

(2) A terminals connecting structure as set forth under (1) above, wherein the terminal block is an inverter terminal block which is mounted so as to be inserted into a terminal housing which constitutes part of a housing of inverter equipment, and wherein the two types of terminals are an inverter connector terminal and a capacitor bus-bar terminal.

According to the terminals connecting structure configured as described under (1) above, the plunging prevention portion is provided at the leading end portion of the terminal which enters first and the guide rib is provided on the terminal block, whereby even in the event that the posture of the terminal which enters later is inclined, the inclination of the terminal can be corrected by the guide rib. Thus, in stacking the two types of terminals one on the other on the terminal block for electric connection, the phenomenon can be prevented in which the terminal which is mounted later pushes up the terminal which is mounted first.

According to the terminals connecting structure configured as described under (2) above, in stacking the capacitor bus-bar terminal and the inverter connector terminal one on the other at the block terminal fixing portion, the plunging prevention portion is provided at the leading end portion of the terminal which enters first and the guide rib is provided on the terminal block. Consequently, in stacking the two types of terminals one on the other on the terminal block for connection, even in the event that the posture of the terminal which enters later is inclined, the inclination can be corrected by the guide rib. Thus, the phenomenon can be prevented in which the terminal which is mounted later pushes up the terminal that is mounted first.

Advantageous Effects of Invention

In the terminals connecting structure of the invention, by providing the plunging prevention portion at the leading end portion of the terminal which enters first and providing the guide rib on the electric equipment connecting terminal block, in stacking the two types of connectors one on the other on the terminal block for connection, even in the event that the posture of the terminal which enters later is inclined, the inclination can be corrected by the guide rib. Thus, the terminals connecting structure of the invention is advantageous in that the phenomenon can be prevented in which the terminal which is mounted later pushed up the terminal which is mounted first.

Thus, the invention has been described briefly. Further, the details of the invention will be clarified further by perusing a mode for carrying out the invention which will be described below by reference to the accompanying drawings.

BRIEF DESCRIPTION OF DRAWINGS

FIG. 7 shows an intermediate state of the assembling procedure of the inverter terminal block system according to the embodiment of the invention, in which

DESCRIPTION OF EMBODIMENTS

Figure 1:
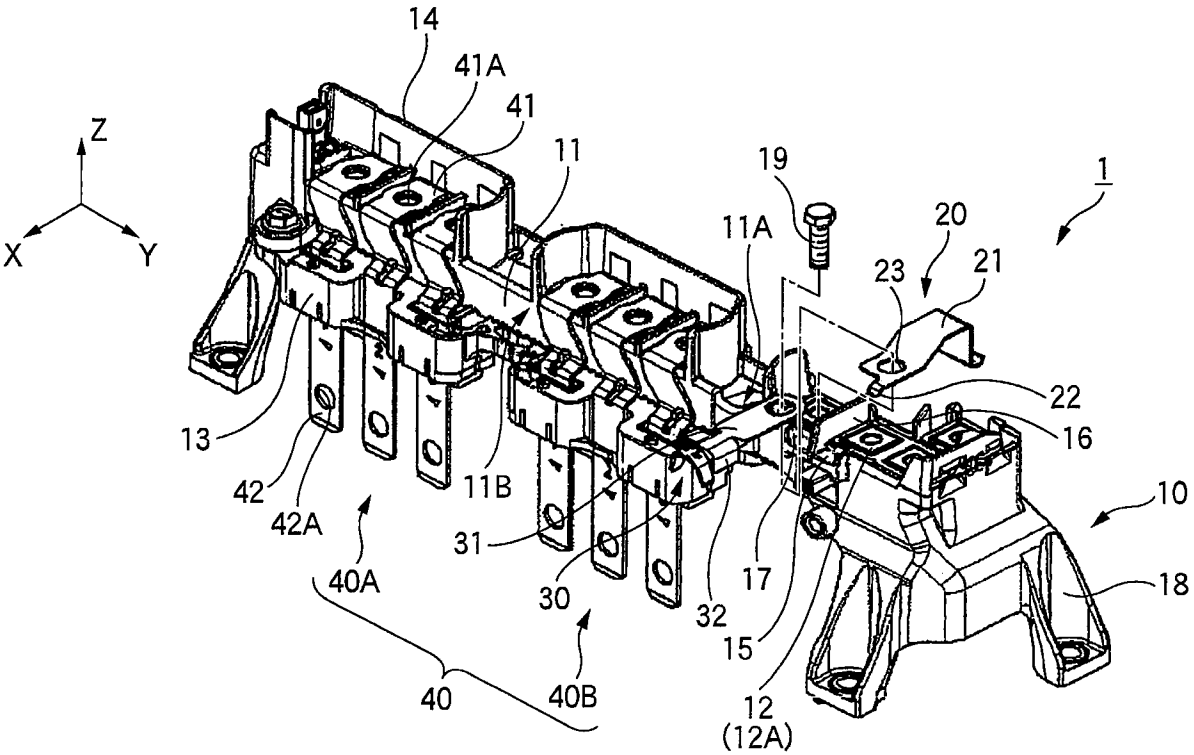
FIG. 1 is an exploded perspective view of an inverter terminal block system to which a terminals connecting structure according to the invention is applied.
Figure 2:
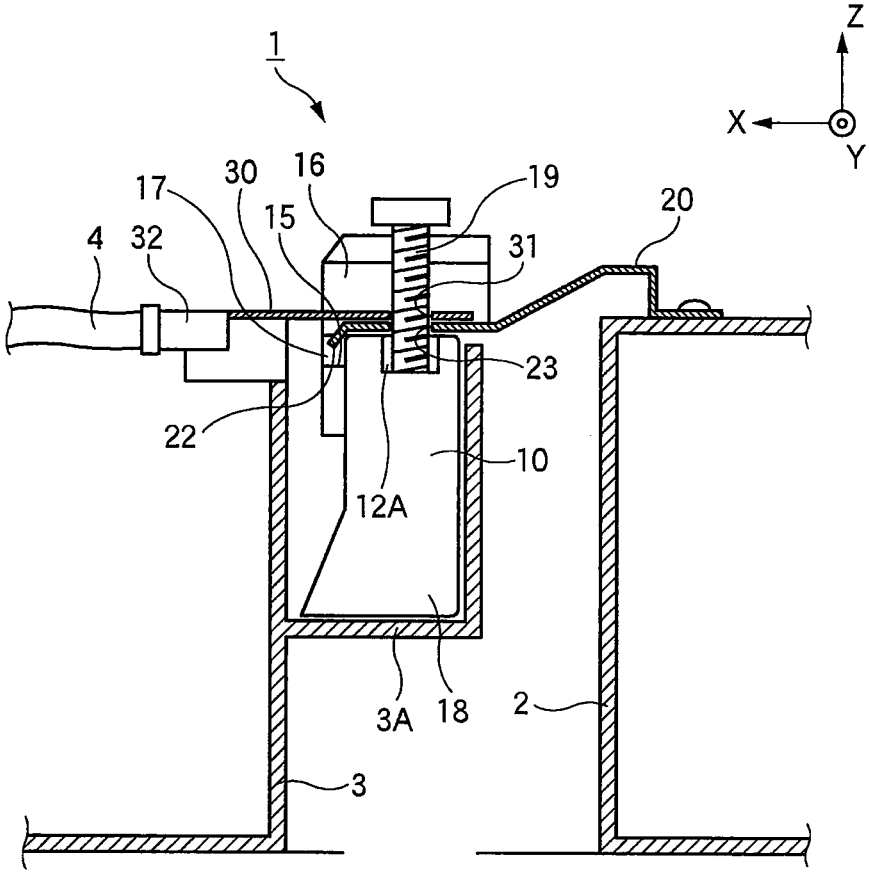
FIG. 2 is an explanatory drawing which shows the inverter terminal block system and a main part of a peripheral portion thereof.

FIGS. 1 and 2 show an inverter terminal block system 1 which configures a terminals connecting system to which a terminals connecting structure according to a first embodiment of the invention is applied. The inverter terminal block system 1 which is installed in an interior of a motor vehicle such as a hybrid vehicle (or an electric vehicle), for example, includes an inverter terminal block 10, capacitor bus-bar terminals 20, inverter connector terminals 30 and a connector terminal 40 for connection with electric equipment such as a motor (hereinafter, referred to as an "electric equipment connector terminal").

The inverter terminal block 10 is formed of a suitable insulating material such as a plastic resin. The inverter terminal block 10 of the embodiment includes a main body 11 on which leg portions 18 are provided and which has a bridge-like configuration, a group of block terminal fixing portions 12 which are disposed into a line on an upper side 11A of the main body 11, terminal mounting portions 13 which are provided on a lateral side 11B of the main body 11 so as to project therefrom, plate-shaped cover portions 14 which are provided on the upper side 11A of the main body 11 to project upwards therefrom so as to surround individually respective sets of inverter terminals 42 (in total, two sets of inverter terminals 42 each including three terminals) of the electric equipment connector terminal 40, the inverter terminal 42 being described later, two stages 15 which project from the lateral side 11B of the main body 11 so as to correspond to two nut 12A installation portions which constitute part (a block terminal fixing portion) of the group of block terminal fixing portions 12, a partition wall 16 which is provided at a boundary portion between the adjacent stages 15 and the two nuts 12A, and guide ribs 17 which are formed integrally on outer circumferential edge portions of the stages 15.

The inverter terminal block 10 of the embodiment is accommodated in part of an inverter housing (hereinafter, referred to as a "terminal housing 3A") shown in FIG. 2, for example, so that the inverter terminal block 10 is installed in a predetermined position which is set in advance at a predetermined height. The leg portions 18 are fixed to the terminal housing 3A with bolts, which are not shown.

The group of terminal fixing portions 12 includes a plurality of block terminal fixing portions which constitute fixing means (herein, nuts are used) by which terminals are connected together. In this embodiment, four nuts 12A which configure the block terminal fixing portions are provided on the upper side 11A of the main body 11. These nuts 12A are fixed to the main body 11 so as to be embedded therein with their upper side portions left exposed on the upper side 11A of the main body 11.

Two nuts 12A in the four nuts 12A are used so that the capacitor bus-bars 20 and the inverter connector terminals 30 are stacked one on the other. Namely, in this embodiment, the pair of positive and negative capacitor bus-bar terminals 20 and the inverter connector terminals 30 which are provided so as to correspond to the capacitor bus-bar terminals 20 are stacked together and are then fastened with bolts.

In this embodiment, six nuts are provided further on the main body 11 so as to be embedded therein with their upper side portions left exposed on the upper side 11A of the main body 11 so that a pair of terminals, not shown, for controlling a pair of three-phase alternating current motors (a primary and secondary motors) and output terminals, not shown, of a pair of inverters (a primary and secondary inverters) are stacked one on the other so as to be fastened together with bolts.

The four nuts 12A and the six nuts (which lie invisible behind electric equipment connecter terminals 40A, 40B) are attached fixedly and integrally to the inverter terminal block 10 through insert molding in forming the inverter terminal block 10 of a suitable plastic resin made of an insulating material.

In order for the two sets of electric equipment connector terminals 40 each including three terminals to be disposed so that they are individually separated from each other so as to be insulated, the terminals lying on both end sides of each of electric equipment connector terminals 40A, 40B are individually inserted into the terminal mounting portions 13 to thereby be attached thereto. Note that the terminal mounting portions 13 of the embodiment are formed integrally with the inverter terminal block 10.

Figure 5A:
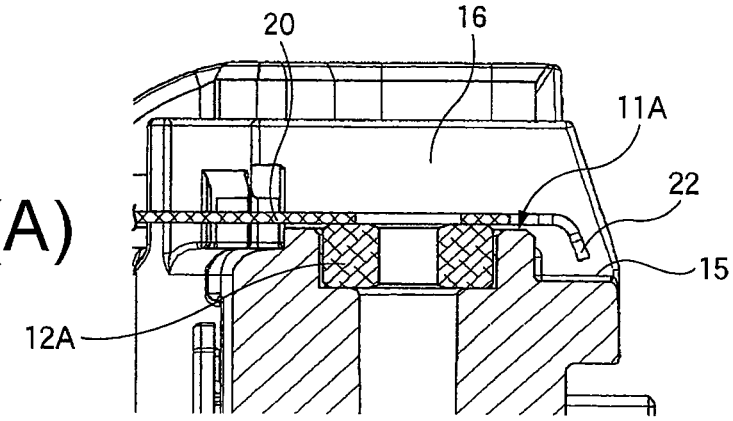
FIGS. 5(A) to 5(C) are sectional views taken along the lines VA-VA to VC to VC in FIG. 4, respectively.
Figure 5B:
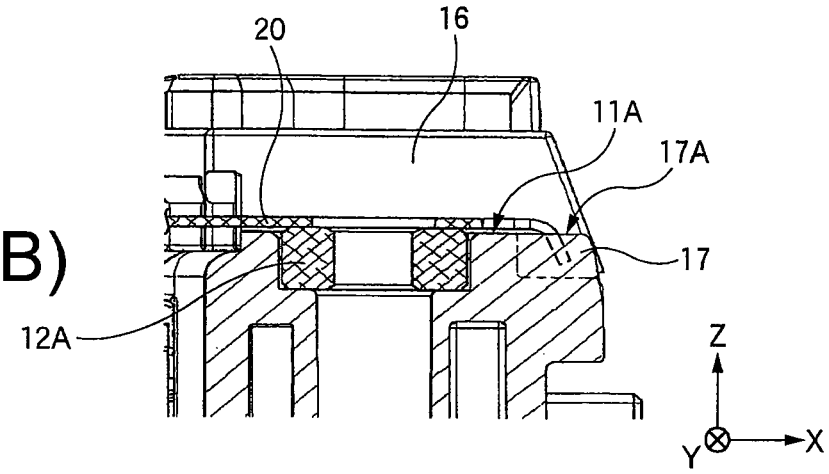

The stage 15 is placed so that the periphery of a through hole 23 in the capacitor bus-bar terminal 20 can be installed on the nut 12A provided on the upper side 11A f the main body 11 of the inverter terminal block 10 in such a state that the periphery of the through hole 23 is closely attached to or is brought into close contact with the nut 12A (hereinafter, this state being referred to as a "horizontal posture") as is shown in FIG. 5(B). Namely, in order to avoid a situation in which a tongue piece 22 which is formed at a leading end portion of the capacitor bus-bar terminal 20 so as to configure a plunge prevention portion, which will be described later, is locked on the upper side 11A of the main body 11 of the inverter terminal block 10, the stage 15 is made up of a step portion which is lowered by a depth equal to or larger than at least a projecting distance d (refer to FIG. 3(B)) of the tongue piece 22 from an edge portion of the upper side 11A.

Figure 4:
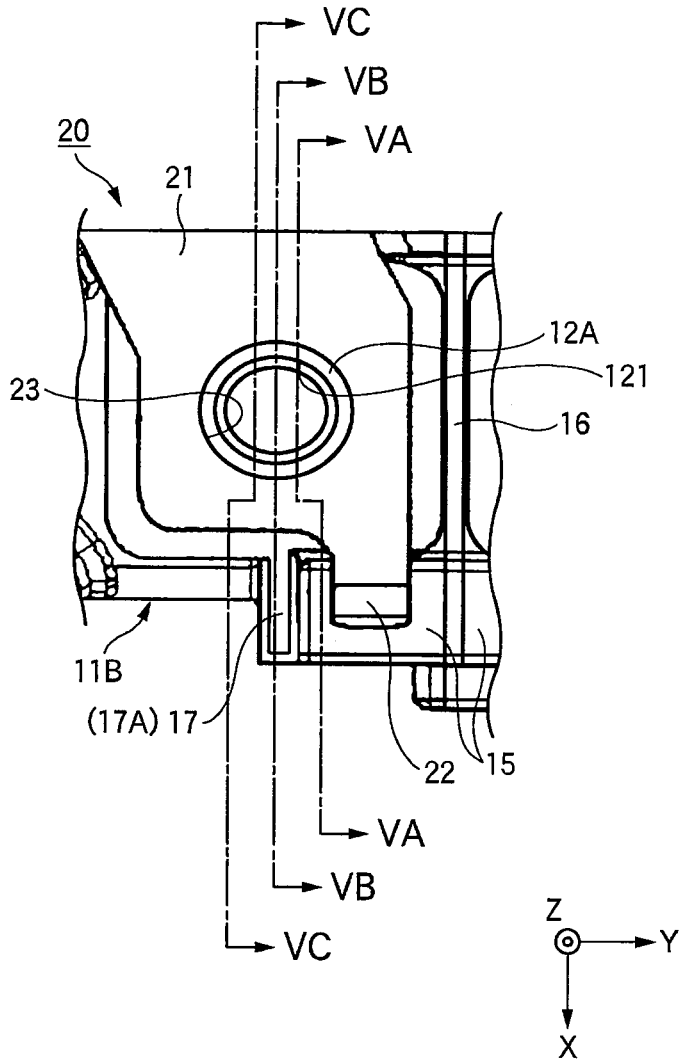
FIG. 4 is a plan view showing a main part of the inverter terminal block in the inverter terminal block system in which its capacitor bus-bar terminal is installed.

As is shown in FIG. 4, the stage 15 is formed eccentrically within an area ranging from a line which passes through a center of a hole 121 of the nut 12A with respect to a width (Y) direction of the capacitor bus-bar terminal 20 and extends in an orthogonal direction relative to the lateral side 11B of the main body 11 (hereinafter, referred to as a "center line") to an end portion (a right-hand lateral side) of left- and right-hand lateral sides of the capacitor bus-bar terminal 20 at a leading end portion of which the tongue piece 22 is formed. In other words, the stage 15 is formed so as to correspond to one-half portion (a right-hand half portion) of the capacitor bus-bar terminal 20 with respect to the width direction thereof.

The partition wall 16 is, as is described above, formed integrally with the main body 11 of the inverter terminal block 10 which is formed of the insulating material so that the two sets of terminals which are provided side by side are electrically separated and insulated from each other so as to prevent the occurrence of a short circuit therebetween. This partition wall 16 is formed so as to be disposed parallel to an X direction which is at right angles to the lateral side 11B (similar to a lateral side on an opposite side). In the event that the capacitor bus-bar terminal 20 and the inverter connector terminal 30 do not travel in parallel with a +X direction and a −X direction, respectively, but enter while being offset in the Y direction, the partition wall 16 can also guide the capacitor bus-bar terminal 20 and the inverter connector terminal 30 so as to correct their traveling directions.

Figure 5C:
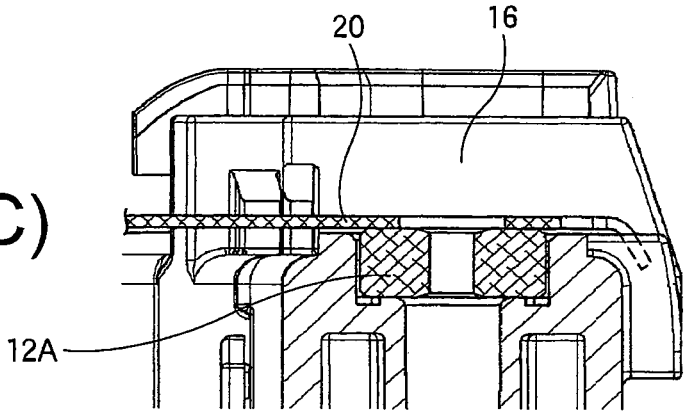

The guide rib 17 is formed on a lateral side of the inverter terminal block 10 which in particular, the inverter connector terminal 30, which is the terminal that enters later, faces when the inverter connector terminal 30 travels, that is, the lateral side 11B so as to project outwards along a direction in which the inverter connector terminal 30 enters. Further, as is shown in FIG. 4, with the capacitor bus-bar terminal 20 which is stacked on the nut 12A seen from the top thereof, the guide rib 17 is positioned at the center of the capacitor bus-bar terminal 20. A specific shape of the guide rib 17 has a construction depicted in FIGS. 5(A) to (C) which are sectional views taken along the lines shown in FIG. 4. As is shown in FIG. 5(B), the guide rib 17 has such a height that an upper side 17A thereof becomes level with the upper side 11A of the min body 11 of the inverter terminal block 10.

Figure 7A:
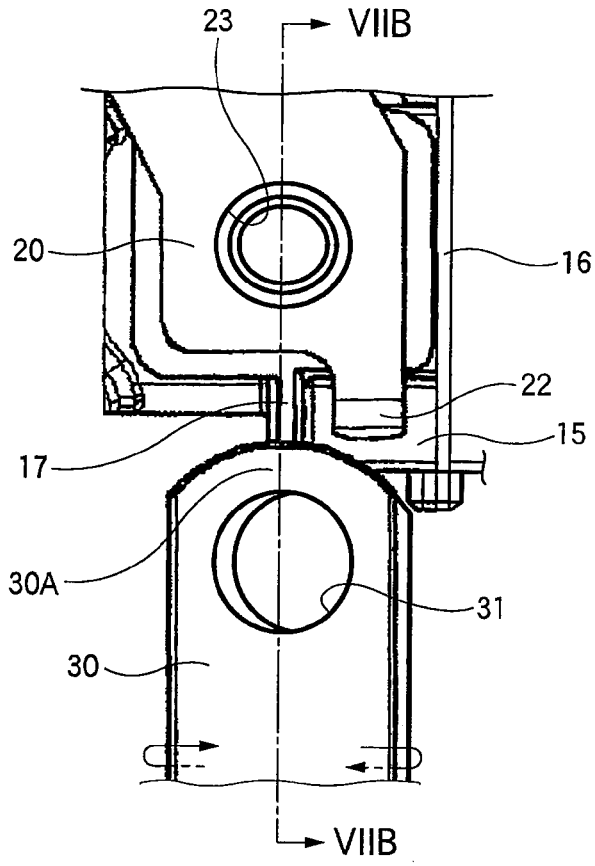
FIG. 7(A) is a plan view of a main part thereof.
Figure 9:
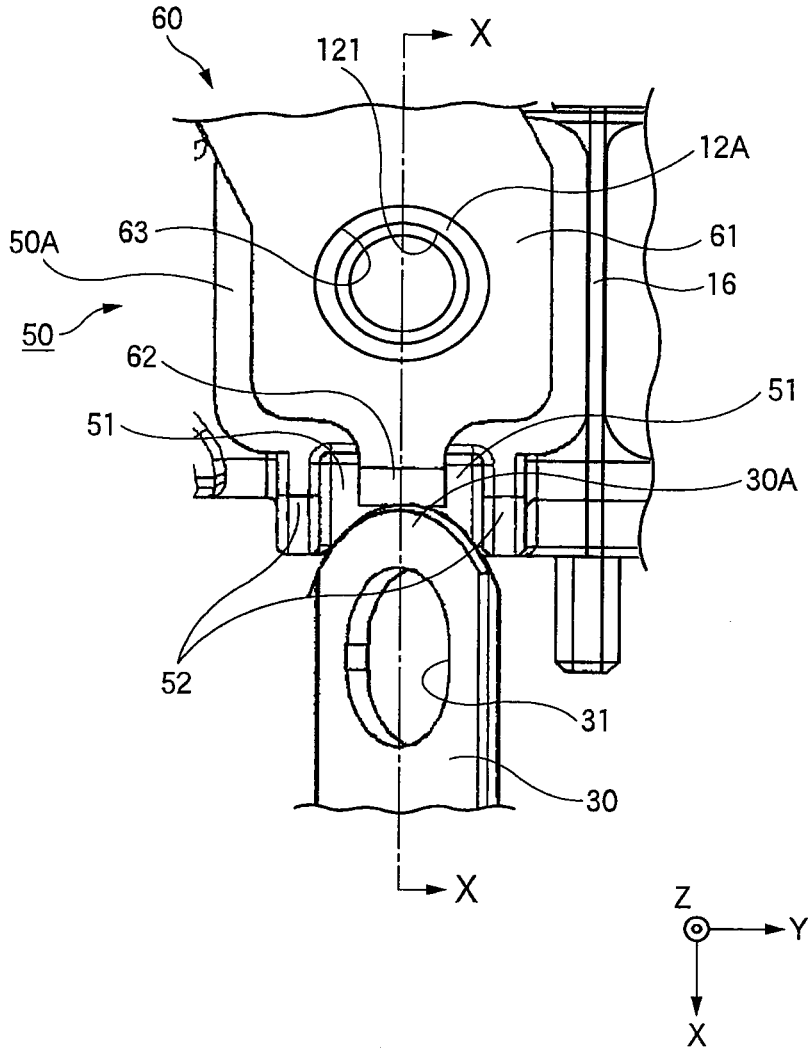
FIG. 9 is a plan view showing the configuration of a main part of a comparison example for the inverter terminal block system according to the embodiment of the invention.

In the guide rib 17, which is formed so as to be disposed in the way described above, in the event that the postures of the inverter connector terminal 30 on its upper and lower sides are collapsed and for example, the lower (upper) side of the inverter connector terminal 30 is not parallel to an X-Y plane as is shown in FIGS. 9 and 10, a central portion of the lower side of the inverter connector terminal 30 is brought into contact with the guide rib 17 to thereby be caused to rise upwards when the inverter connector terminal 30 travels (refer to FIG. 7(A)). As a result, the inverter connector terminal 30 enters towards the nut 12A with the posture thereof corrected so that the lower side of the inverter connector terminal 30 becomes parallel to the upper side 11A of the main body 11, that is, an upper side of the capacitor bus-bar terminal 20.

The capacitor bus-bar terminal 20 effects an electric connection with a capacitor (not shown) which stores electric power regenerated in an electric motor, not shown and is connected to an output terminal (not shown) of the capacitor at one end side thereof. In addition, the capacitor bus-bar connector 20 is connected to the inverter connector terminal 30 at the other end side thereof in the inverter terminal block 10 for feeding a large current outputted therefrom to an inverter.

A specific connection mode between the capacitor bus-bar terminal 20 and the inverter connector terminal 30 will be described as below.

Namely, these terminals 20, 30 are stacked one on the other in the vertical direction and are installed in an appropriate position by passing through holes in the terminals 20, 30 on the nut 12A of the group of block terminal fixing portions 12. Then, a bolt 19 is screwed into the nut 12A so as to fasten the terminals 20, 30 together. Because of this, as with the inverter connector terminal 30, a through hole 23 through which the bolt 19 passes is opened at a leading end side of the capacitor bus-bar terminal 20. When stacking these two terminals (the capacitor bus-bar terminal 20 and the inverter connector terminal 30) one on the other, the capacitor bus-bar terminal 20 is rested on the nut 12A, and thereafter, the inverter connector terminal 30 is stacked thereon.

Figure 3A:
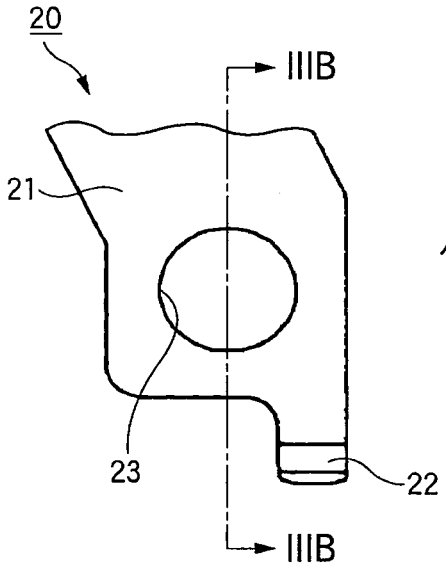
FIG. 3(A) is a plan view of a main part of a capacitor bus-bar terminal which is used in the inverter terminal block system according to an embodiment of the invention and FIG. 3(B) is a sectional view of the capacitor bus-bar terminal taken along the line IIIB-IIIB and viewed in a direction indicated by arrows attached to the line in FIG. 3(A).
Figure 3B:
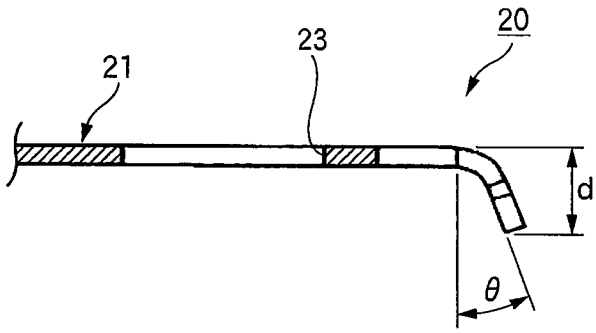

The tongue piece 22, which configures the plunge prevention portion, is formed on the capacitor bus-bar terminal 20, which is the terminal which enters first towards the nut 12A of the group of block terminal fixing portions 12. As is shown in FIG. 3, the tongue piece 22 of this embodiment is bent so as to be curved inwards (downwards in FIG. 1) towards the main body 11 of the terminal block 10 and is formed so as to be offset closer to an end portion on one side of the leading portion. In other words, the tongue piece 22 does not reach a central portion of the leading end portion of the capacitor bus-bar terminal 20 with respect to the width direction thereof (or up to the central portion even in a case in which the tongue piece 22 extends longest) to thereby be formed only on one side of the capacitor bus-bar terminal 20 with respect to the width direction thereof. This tongue piece 22 projects downwards smoothly (for example, roundly) into a curved shape (or an arc-like shape) from the upper side 21 of the capacitor bus-bar terminal 20 by a dimension which is equal to or larger than a gap $\alpha$ (refer to FIG. 5), which will be described later, (however, $d>\alpha$.

Moreover, this tongue piece 22 is formed into a shape which forms a slope which is inclined at an angle $\theta$ not in a thickness direction (a vertically downward direction relative to the upper side 21) but in a slightly outward direction of the capacitor bus-bar terminal 20.

The inverter connector terminals 30 effect a connection with input terminals of a pair of inverters, not show, which generate driving currents for the pair of three-phase alternating current motors, not shown, in which the inverter terminal block system 1 of the embodiment is loaded, and two sets of inverter connector terminals 30 each including two inverter connector terminals 30 as a pair. A through hole 31 (refer to FIG. 7(A)) is opened in a leading end portion of the inverter connector terminal 31 through which the bolt 19 is passed. In addition, an electric wire holding portion 32 is formed, as is shown in FIG. 2, in a proximal end portion which is connected to one end portion of an electric wire (hereinafter, referred to as an "inverter electric wire 4") through soldering. The other end side of the inverter electric wire 4 is connected to the input terminal of the inverter, not shown.

The inverter, not shown, generates a driving current for the three-phase alternating current motor, not shown, and is accommodated within the inverter housing 3 shown in FIG. 2. The terminal housing 3A is formed integrally on a wall surface of the inverter housing 3.

The electric equipment connector terminal 40 effects a connection between the inverter and the three-phase alternating current motor. The electric equipment connector terminal 40 is disposed so as to extend downwards from the upper side of the main body 11 along the lateral side 11B of the inverter terminal block 10, as is shown in FIG. 1. The electric equipment connector terminal 40 of the embodiment is made up of the two sets of electric equipment connector terminals 40 each including the three terminals, that is, a primary connector terminal 40A for connecting the primary inverter with the primary three-phase alternating current motor and a secondary connector terminal 40B for connecting the secondary inverter and the secondary three-phase alternating current motor.

Each electric equipment connector terminal 40 is formed of a narrow elongated conductive material. An intermediate portion of the electric equipment connector terminal 40 is bent into a substantially S-shape (or a substantially shallow V-like shape) in section. A terminal portion 41 for connection with a drive control terminal (not shown) of the three-phase alternating current motor (hereinafter, referred to as a "motor terminal portion") is provided at one end portion (an upper end portion in FIG. 1), and a terminal portion 42 for connection with an output terminal of the inverter (hereinafter, referred to as an "inverter terminal portion") is provided at the other end portion of the electric equipment connector terminal 40.

As with the capacitor bus-bar terminal 20 and the inverter connector terminal 30, a through hole 41A and a through hole 42A are also opened in end portions of the motor terminal portion 41 and the inverter terminal portion 42, respectively, so that bolts, not shown, can be passed therethrough.

Next, an assembling method of the inverter terminal block system 1 of the embodiment will be described. Here, in particular, a connecting procedure will be described in detail which is adopted in stacking the capacitor bus-bar terminal 20 and the inverter connector terminal 30 one on the other on the upper side 11A of the main body 11 of the inverter terminal block 10 and thereafter, fastening both the terminals together for connection with the bolt 19.

Initially, the capacitor bus-bar terminal 20 which is connected to the output terminal of the capacitor is set on the nut 12A provided on the upper side 11A of the main body 11 of the inverter terminal block 10 while aligning it with the nut 12A so provided. Namely, the capacitor bus-bar terminal 20 is caused to enter towards the nut 12A so that the through hole 23 in the capacitor bus-bar terminal 20 and the hole in the nut 12A coincide with each other and is then stacked on the capacitor bus-bar terminal 20.

Next, the inverter connector terminal 30 is stacked on the capacitor bus-bar terminal 20 while being aligned therewith. Namely, the inverter connector terminal 30 is also caused to enter towards the nut 12A so that the through hole 31 in the inverter connector terminal 30 coincides with the through hole 23 in the capacitor bus-bar terminal 20 and the hole in the nut 12A and is then stacked on the capacitor bus-bar terminal 20.

The bolt 19 is inserted from above the inverter connector terminal 30 in this state. Then, a tip of the bolt 19 is inserted through the through holes 31, 23 of the inverter connector terminal 30 and the capacitor bus-bar terminal 20 in that order, whereby the bolt 19 is screwed into the nut 12A.

Here, in a housing mounted on a predetermined place of a vehicle body, not shown, that is, in a capacitor housing 2 (refer to FIG. 2), the other end, not shown, of the capacitor bus-bar connector 20 is connected to the output terminal of the capacitor, not shown, which is accommodated in the capacitor housing 2. Similarly, the inverter terminal block 10 is also accommodated in the terminal housing 3A which is provided integrally on the wall surface of the housing mounted in a predetermined place of the vehicle body, not shown, that is, the inverter housing 3 in the inverter housing 3.

Figure 7B:
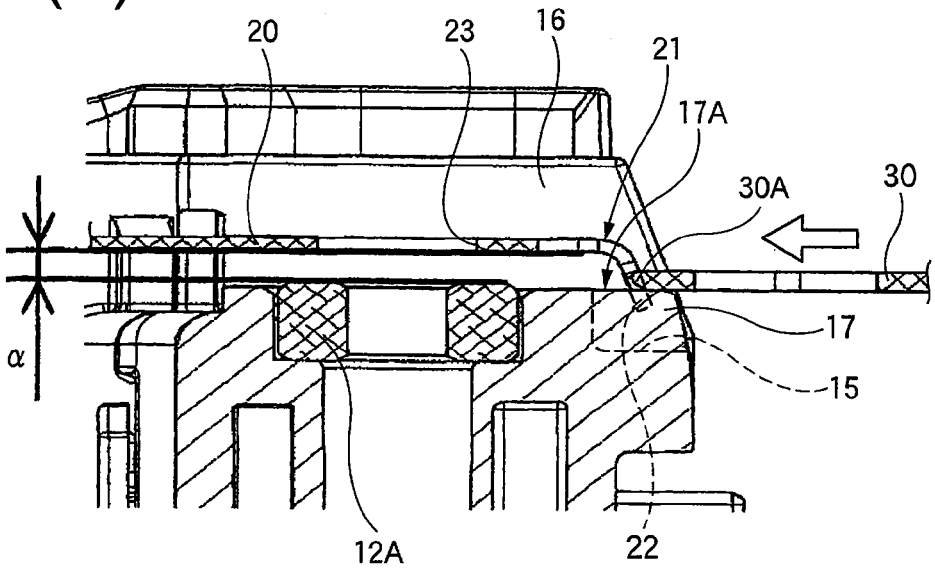
FIG. 7(B) is a sectional view showing a state immediately after the correction of a posture of an inverter connector which occurs after a slight length of time has elapsed from the advanced state shown in FIG. 7(A).

There may be a case in which the gap $\alpha$ is normally produced within a range of a tolerance as is shown in FIG. 7(B) between the capacitor bus-bar terminal 20 and the upper side 11A of the main body of the inverter terminal block 10 (to be precise, the upper side of the nut 12A) which are disposed in the relationship described above.

Figure 6:
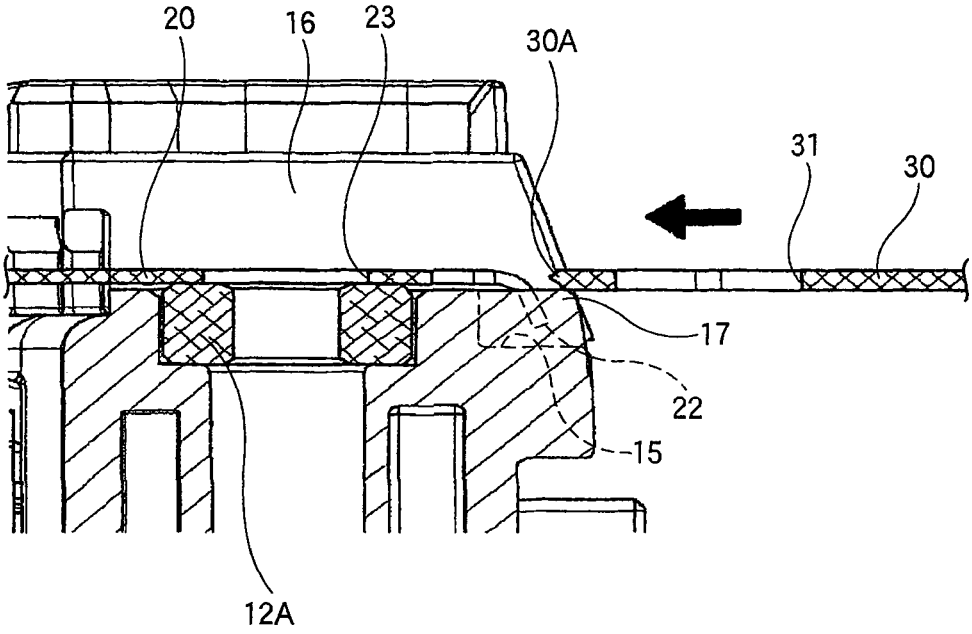
FIG. 6 is an explanatory drawing showing an initial state of an assembling procedure of the inverter terminal block system according to the embodiment of the invention.
Figure 8:
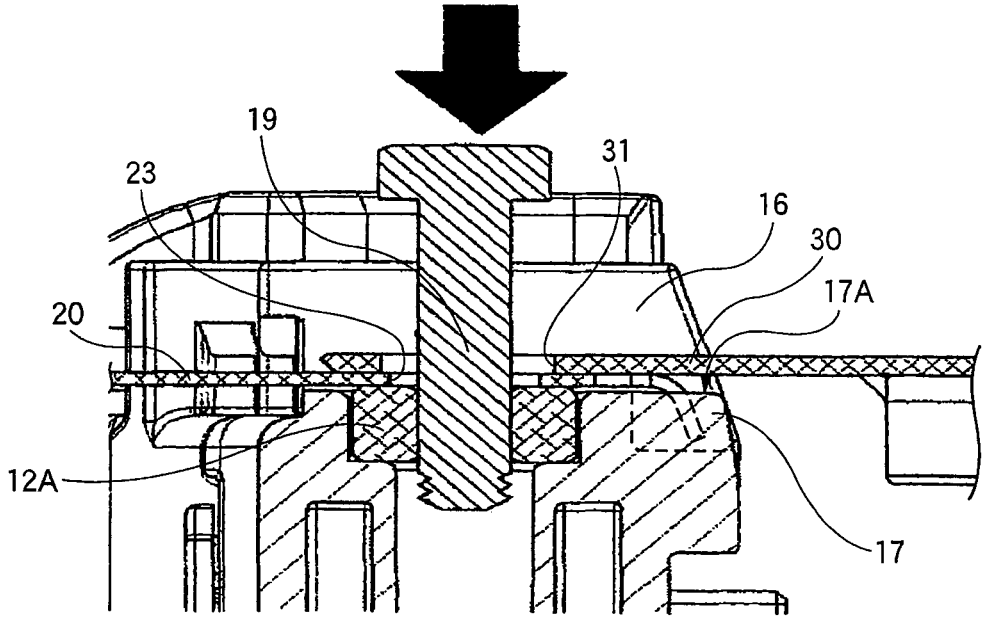
FIG. 8 is an explanatory drawing showing a state in which the inverter terminal block system according to the embodiment of the invention has been built up completely by following the assembling procedure of the inverter terminal block system according to the embodiment of the invention.

In inserting the inverter connector terminal 30 from its leading end 30A into the capacitor bus-bar terminal 20 which is waiting to receive it on the upper side 11A of the main body 11 of the inverter terminal block 10 so as to stack the inverter connector terminal 30 on the capacitor bus-bar terminal 20, for example, let's imagine that the gap $\alpha$ were almost zero. In this case, as is shown in FIGS. 6, 7(B) and 8, the inverter connector terminal 30 is disposed smoothly on the capacitor bus-bar terminal 20 without any problem.

On the other hand, a case is considered to occur in which the gap $\alpha$ is formed on the upper surface 11A of the main body 11 of the inverter terminal block 10 within the range of the tolerance and in which a leading end face of the inverter connector terminal 30 is fed not in parallel with the upper side 11A of the main body 11 of the inverter terminal block 10 but while being inclined relative thereto as is shown in FIG. 10 which shows sectional views of FIG. 9. A connecting procedure adopted in this case will be described while comparing with FIGS. 9 and 10.

Initially, a comparison example shown in FIGS. 9 and 10 will be described. An inverter terminal block 50 shown in FIG. 9 is illustrated for reference as a comparison example so as to understand the function of the inverter terminal block 10 of the embodiment.

The inverter terminal block 50 of the comparison example differs from the inverter terminal block 10 according to the embodiment shown in FIG. 4 in that a stage 51 which is provided so as to correspond to a nut 12A is disposed laterally symmetrical with respect to a center line (similar to the X-X line shown in FIG. 9) which passes through a center of the nut 12A and in that guide ribs 52 are formed on edge portions on left- and right-hand side of the stage 51. In addition, a capacitor bus-bar terminal 60 used here differs from the capacitor bus-bar terminal 20 of the embodiment in that a tongue piece 62 is formed not along either of left and right lateral sides but at a central portion of a leading end of the capacitor bus-bar terminal 60.

Figure 10A:
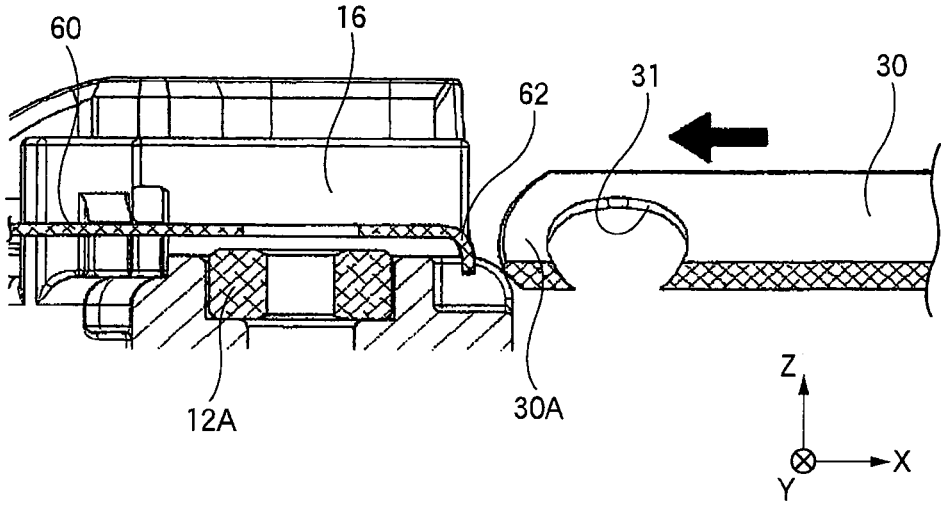
FIGS. 10(A) and 10(B) are sectional views of a main part of the comparison example which show a drawback produced by the application of the comparison example shown in FIG. 9.

In the inverter terminal block 50 which is configured in the way described above, as is shown in FIG. 10(A), should an inverter connector terminal 30 travel not in parallel with an upper side 50A of the inverter terminal block 50 but with a posture in which the inverter connector terminal 30 is inclined relative thereto, as is shown in FIGS. 9 and 10, in the event that the inverter connector terminal 30 comes into contact with the capacitor bus-bar terminal 60 at a leading end thereof, a phenomenon is produced in which the leading end of the inverter connector terminal 30 is pushed upwards. As a result, there is a fear that the leading end 30A of the inverter connector terminal 30 plunges under a lower side of the capacitor bus-bar terminal 60.

Figure 10B:
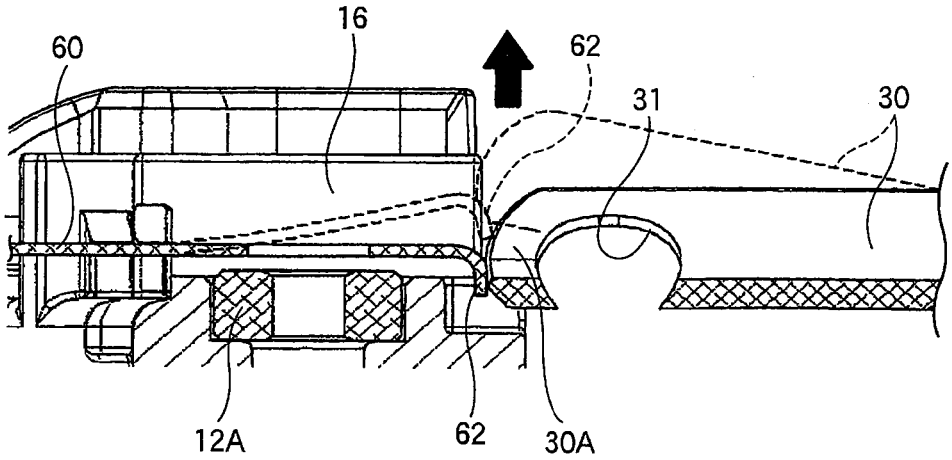
Figure 11:
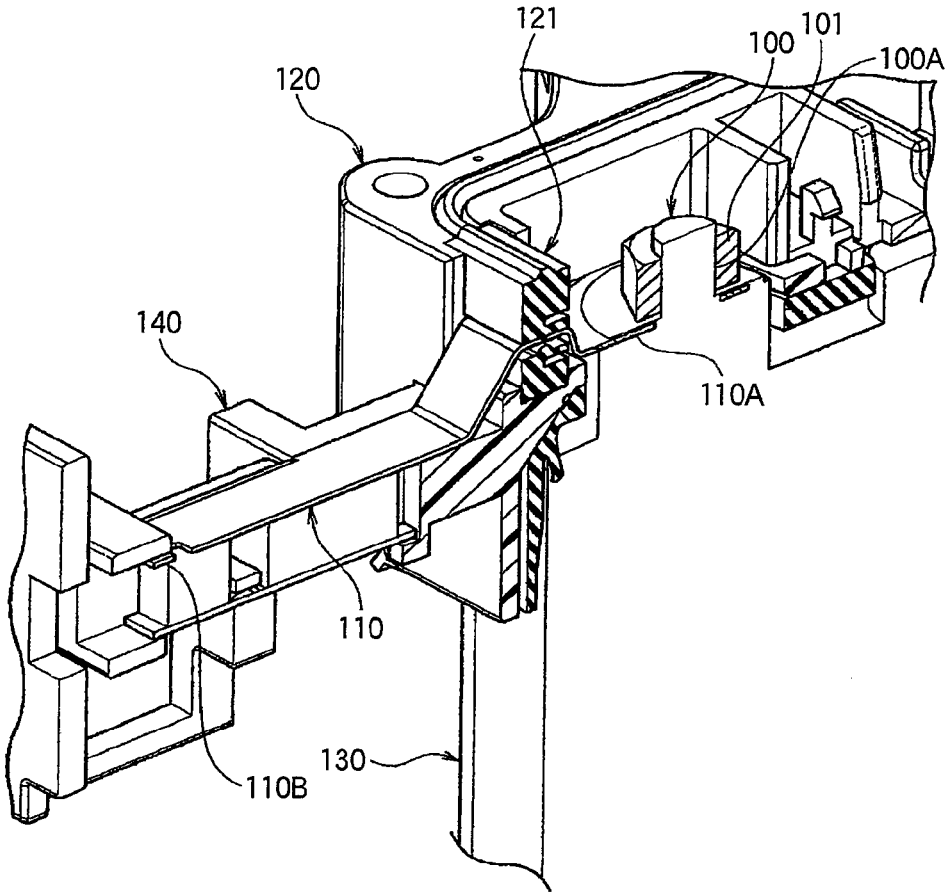
FIG. 11 is a perspective view of a main part showing a conventional terminals connecting structure.

On the other hand, in the inverter terminal block 10 of the embodiment shown in FIG. 4, as is shown in FIG. 7(A), the leading end 30A of the inverter connector terminal 30 is brought into contact with the guide rib 17 so as to be guided by the guide rib 17, whereby the lower side which is lowered downwards compared with the case in which the inverter connector terminal 30 is level with the upper side 11A of the main body 11 of the inverter terminal block 10 is caused to rise. By doing so, the inverter connector terminal 30 is corrected to a posture in which the inverter connector terminal 30 is level with the upper side 11A of the main body 11 of the inverter terminal block 10. As a result, the generation of a thrusting phenomenon shown in FIG. 10(B) is suppressed in which the leading end of the inverter connector terminal 30 strikes the leading end of the capacitor bus-bar connector 20 so as to be bent back in an upper direction.

Consequently, thereafter, when the leading end 30A of the inverter connector terminal 30 strikes the tongue piece 22 as is shown in FIG. 7(B), the tongue piece 22 is guided by an outer surface (the upper side 21) of the capacitor bus-bar connector 20 which is inclined smoothly outwards. Then, the inverter connector terminal 30 enters to a predetermined position while sliding on the upper side 21A of the capacitor bus-bar connector 20 to thereby be stacked on the upper side 21 as is shown in FIG. 8. Consequently, the occurrence of a connection error can be avoided which would otherwise be produced by the inverter connector terminal 30 plunging under the lower side of the capacitor bus-bar terminal 20.

The invention is not limited in any way to the embodiment that has been described heretofore and can be carried out in various modes without departing from the spirit and scope of the invention.

This application is based upon and claims the benefit of priority of Japanese Patent Application No. 2009-214492 filed on Sep. 16, 2009, the contents of which are incorporated herein by reference.

REFERENCE SIGNS LIST

1 inverter terminal block system; 2 capacitor housing (housing); 3 inverter housing (housing); 3A terminal housing; 4 inverter electric wire; 10 inverter terminal block (terminal block); 11 main body; 11B lateral side; 12 group of block terminal fixing portions; 12A nut (block terminal fixing portion); 13 terminal mounting portion; 14 cover portion; 15 stage; 16 partition wall; 17 guide rib; 18 leg portion; 19 bolt; 20 capacitor bus-bar terminal; 21 upper side; 22 tongue piece (plunge prevention portion); 23 through hole; 30 inverter connector terminal; 31 through hole; 32 electric wire holding portion; 40 electric equipment connector terminal; 40A primary connector terminal; 40B secondary connector terminal; 41 motor terminal portion; 42 inverter terminal; 50 inverter terminal block; 60 capacitor bus-bar terminal; d projecting distance of tongue piece (plunge prevention portion); α gap.

The invention claimed is:

1. A terminals connecting structure, comprising:

a terminal block including a group of block terminal fixing portions;

two types of terminals that are entered from different directions towards the group of block terminal fixing portions and that are stacked one on the other on at least a block terminal fixing portion of the group of block terminal fixing portions, the two types of terminals and the block terminal fixing portion being fastened and assembled together with a bolt;

wherein a plunging prevention portion that is bent inwards towards the terminal block is formed at a leading end portion of a terminal of the two types of terminals which enters first the block terminal fixing portion; and wherein a guide rib which projects outwards along a direction in which a terminal which enters later enters is formed in a position on a lateral side of the terminal block which lies in proximity to the block terminal fixing portion and faces the terminal which enters later.

2. The terminals connecting structure as set forth in claim 1, wherein the terminal block is an inverter terminal block which is mounted so as to be inserted into a terminal housing which constitutes part of a housing of inverter equipment, and wherein the two types of terminals are an inverter connector terminal and a capacitor bus-bar terminal.

3. The terminal connecting structure as set forth in claim 1, wherein with the terminal which enters first to be stacked on the block terminal fixing portion seen from the top, the guide rib is positioned at a center of the terminal which enters first.

* * * * *